US006494517B1

(12) United States Patent
Durant

(10) Patent No.: US 6,494,517 B1
(45) Date of Patent: Dec. 17, 2002

(54) EATING IMPLEMENT

(76) Inventor: Madeline G. Durant, 22 Primrose La., Kings Park, NY (US) 11754

( * ) Notice: Subject to any disclaimer, the term of this patent is extended or adjusted under 35 U.S.C. 154(b) by 0 days.

(21) Appl. No.: 09/931,831

(22) Filed: Aug. 17, 2001

(51) Int. Cl.[7] ..... A47J 43/28
(52) U.S. Cl. ..... 294/99.2; 294/33
(58) Field of Search ..... 294/3, 5, 8.5, 11, 294/16, 33, 99.2, 100; 30/142, 147, 150, 322; D7/643, 683, 686

(56) References Cited

U.S. PATENT DOCUMENTS

| | | | | | |
|---|---|---|---|---|---|
| 523,136 | A | * | 7/1894 | Trakofler | 294/99.2 |
| 692,274 | A | * | 2/1902 | Gumaer | 295/8.5 X |
| 1,468,718 | A | * | 9/1923 | Kneeland | 294/99.2 |
| 2,263,965 | A | * | 11/1941 | Fiori | 294/99.2 |
| 2,474,167 | A | * | 6/1949 | Rundell | 294/33 |
| 2,532,406 | A | * | 12/1950 | Jernigan | 294/99.2 |
| 2,768,856 | A | * | 10/1956 | Wright | 294/99.2 |
| 2,839,325 | A | * | 6/1958 | Jeanfavre | 294/99.2 |
| 3,889,995 | A | * | 6/1975 | Lin | 294/99.2 |
| 3,934,915 | A | * | 1/1976 | Humpa | 294/99.2 |
| 4,002,365 | A | | 1/1977 | Rader | |
| 4,707,922 | A | | 11/1987 | Hosak-Robb | |
| 4,728,139 | A | * | 3/1988 | Oretti | 294/99.2 |
| 5,934,721 | A | | 8/1999 | Walde | |

* cited by examiner

*Primary Examiner*—Johnny D. Cherry

(57) ABSTRACT

A eating implement for holding the bone portion of ribs, chicken and other foods. The eating implement includes a tong-shaped member having a pair of arms each having a first end attached to a resiliently flexible connector. The arms extend outwardly in a generally parallel direction with respect to each other. The arms each have an outer surface and an inner surface. The inner surfaces face each other. Each of the arms has a first edge and a second edge. Each of the arms has a middle portion, a distal portion and proximal portion with respect to the connector A holding member extends around the tong-shaped member and is positioned between the distal and proximal portions of the arms for holding the arms in a static relationship to each other.

6 Claims, 1 Drawing Sheet

EATING IMPLEMENT

BACKGROUND OF THE INVENTION

1. Field of the Invention

The present invention relates to eating devices and more particularly pertains to a new eating implement for holding the bone portion of ribs, chicken and other foods.

2. Description of the Prior Art

The use of eating devices is known in the prior art. More specifically, eating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,707,922; U.S. Pat. No. 4,002,365; and U.S. Pat. No. 5,934,721.

While these devices fulfill their respective, particular objectives and requirements, the aforementioned patents do not disclose a new eating implement. The inventive device includes a tong-shaped member having a pair of arms each having a first end attached to a resiliently flexible connector. The arms extend outwardly in a generally parallel direction with respect to each other. The arms each have an outer surface and an inner surface. The inner surfaces face each other. Each of the arms has a first edge and a second edge. Each of the arms has a middle portion, a distal portion and proximal portion with respect to the connector. A holding member extends around the tong-shaped member and is positioned between the distal and proximal portions of the arms for holding the arms in a static relationship to each other.

In these respects, the eating implement according to the present invention substantially departs from the conventional concepts and designs of the prior art, and in so doing provides an apparatus primarily developed for the purpose of holding the bone portion of ribs, chicken and other foods.

SUMMARY OF THE INVENTION

In view of the foregoing disadvantages inherent in the known types of eating devices now present in the prior art, the present invention provides a new eating implement construction wherein the same can be utilized for holding the bone portion of ribs, chicken and other foods.

The general purpose of the present invention, which will be described subsequently in greater detail, is to provide a new eating implement apparatus and method which has many of the advantages of the eating devices mentioned heretofore and many novel features that result in a new eating implement which is not anticipated, rendered obvious, suggested, or even implied by any of the prior art eating devices, either alone or in any combination thereof.

To attain this, the present invention generally comprises a tong-shaped member having a pair of arms each having a first end attached to a resiliently flexible connector. The arms extend outwardly in a generally parallel direction with respect to each other. The arms each have an outer surface and an inner surface. The inner surfaces face each other. Each of the arms has a first edge and a second edge. Each of the arms has a middle portion, a distal portion and proximal portion with respect to the connector. A holding member extends around the tong-shaped member and is positioned between the distal and proximal portions of the arms for holding the arms in a static relationship to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new eating implement apparatus and method which has many of the advantages of the eating devices mentioned heretofore and many novel features that result in a new eating implement which is not anticipated, rendered obvious, suggested, or even implied by any of the prior art eating devices, either alone or in any combination thereof.

It is another object of the present invention to provide a new eating implement which may be easily and efficiently manufactured and marketed.

It is a further object of the present invention to provide a new eating implement which is of a durable and reliable construction.

An even further object of the present invention is to provide a new eating implement which is susceptible of a low cost of manufacture with regard to both materials and labor, and which accordingly is then susceptible of low prices of sale to the consuming public, thereby making such eating implement economically available to the buying public.

Still yet another object of the present invention is to provide a new eating implement which provides in the apparatuses and methods of the prior art some of the advantages thereof, while simultaneously overcoming some of the disadvantages normally associated therewith.

Still another object of the present invention is to provide a new eating implement for holding the bone portion of ribs, chicken and other foods.

Yet another object of the present invention is to provide a new eating implement which includes a tong-shaped member having a pair of arms each having a first end attached to a resiliently flexible connector. The arms extend outwardly in a generally parallel direction with respect to each other. The arms each have an outer surface and an inner surface. The inner surfaces face each other. Each of the arms has a first edge and a second edge. Each of the arms has a middle portion, a distal portion and proximal portion with respect to the connector. A holding member extends around the tong-shaped member and is positioned between the distal and proximal portions of the arms for holding the arms in a static relationship to each other.

Still yet another object of the present invention is to provide a new eating implement that holds food so that the user's hands remain clean.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
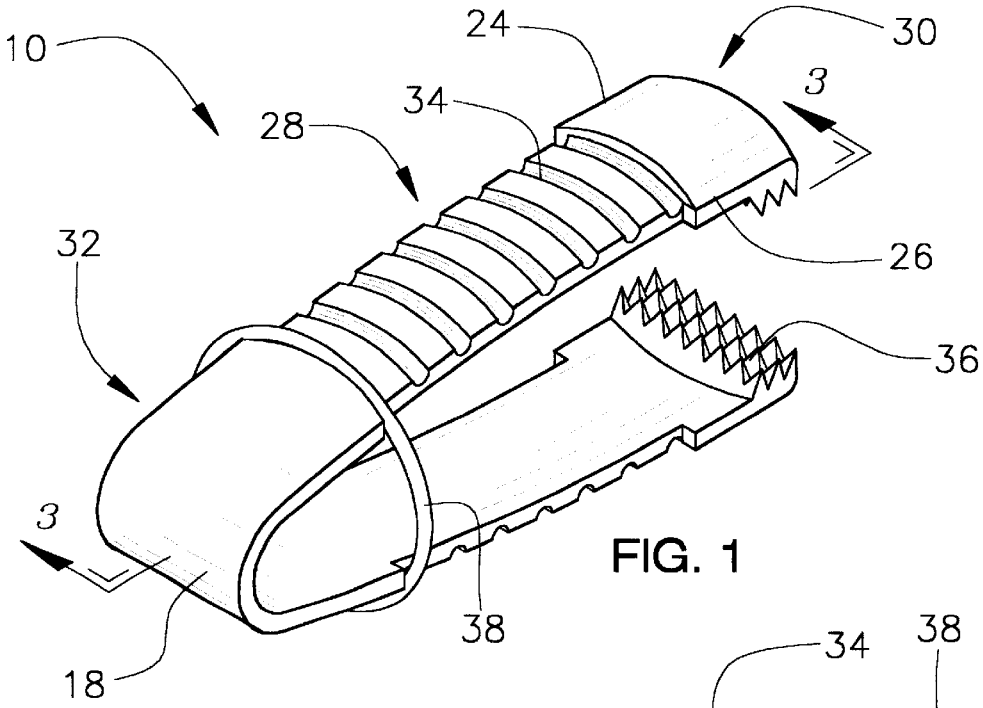
FIG. 1 is a schematic perspective view of a new eating implement according to the present invention.
Figure 2:
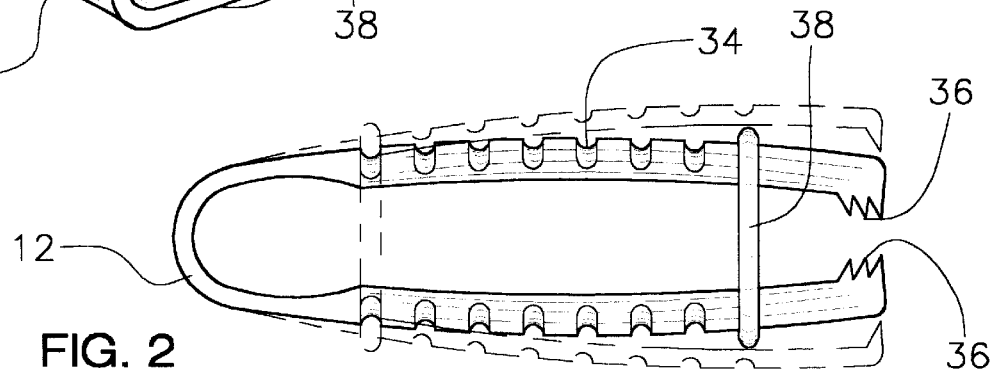
FIG. 2 is a schematic side view of the present invention.
Figure 3:
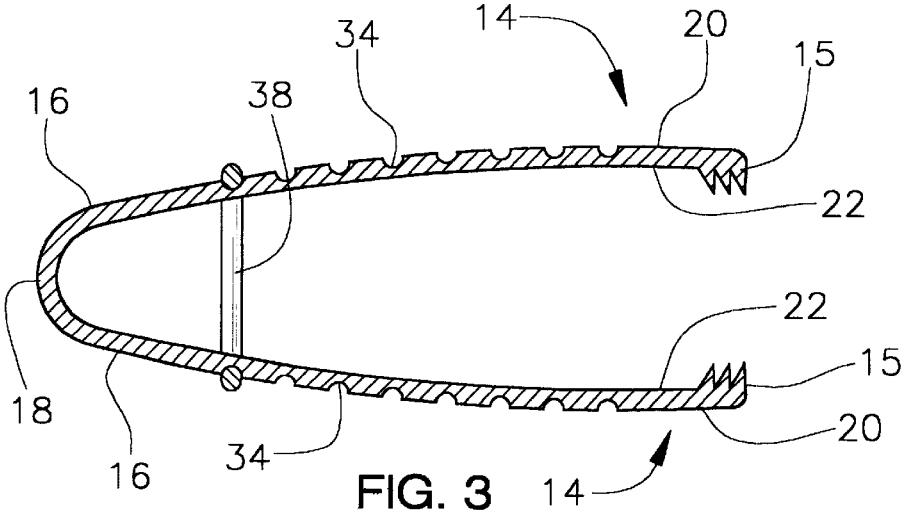
FIG. 3 is a schematic cross-sectional view taken along line 3—3 of FIG. 1 of the present invention.

With reference now to the drawings, and in particular to FIGS. 1 through 3 thereof, a new eating implement embodying the principles and concepts of the present invention and generally designated by the reference numeral 10 will be described.

As best illustrated in FIGS. 1 through 3, the eating implement 10 generally comprises a tong-shaped member 12 having a pair of arms 14 each having a first end 16 attached to a resiliently flexible connector 18. The arms 14 extend outwardly-in a generally parallel direction with respect to each other. The connector 18 has a generally arcuate shape. The arms 14 each have an outer surface 20 and an inner surface 22, wherein the inner surfaces 22 face each other. Each of the arms 14 has a first edge 24, a second edge 26, a middle portion 28, a distal portion 30 and proximal portion 32 with respect to the connector 18. The first 24 and second 26 edges define opposite edges. Each of the middle portions 28 has a width between edges 24, 26 less than the width of the proximal 32 and distal 30 portions. Each of the outer surfaces 20 of the middle portions 28 has a plurality of channels 34 therein extending between opposite edges 24, 26. The arms 14 preferably have a length between 2 inches and 4 inches. Ideally, each of the outer surfaces of the arms is curved outwardly from the first edge to the second edge.

A plurality of rows of teeth 36 is attached to each of the arms 14. The rows of teeth 36 are attached to the inner surfaces 22 of the distal portions 30 of the arms 14. Each of the rows of teeth 36 extends between opposite edges of the arms. There are at least two rows of teeth 36 attached to each arm 14 and each of the arms 14 has a row of teeth positioned adjacent to a respective second end 15 of the arms.

A holding member 38 extends around the tong-shaped member 12 and is positioned between the distal 30 and proximal 32 portions of the arms. The holding member 38 comprises a rigid loop having a generally arcuate shape. The holding member 38 is extendable along the arms 14 between the distal 30 and proximal 32 portions such that the holding member 38 may be positioned in the channels 34. The holding member 38 holds the arms 14 in a static relationship to each other.

In use, the holding member 38 is moved adjacent to the proximal portions 32 and the arms 14 opened to receive food, such as the leg of a chicken. The holding member 38 is moved toward the distal portions 30 so that the arms 14 are moved toward each other and the teeth 36 grip the food.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. An eating implement comprising:

a tong-shaped member having a pair of arms each having a first end attached to a resiliently flexible connector, said arms extending outwardly in a generally parallel direction with respect to each other, said connector having a generally arcuate shape, said arms each having an outer surface and an inner surface, said inner surfaces facing each other, each of said arms having a first edge and a second edge, each of said arms having a middle portion, a distal portion and proximal portion with respect to said connector:

a holding member extending around said tong-shaped member and being positioned between said distal and proximal portions of said arms for holding said arms in a static relationship to each other; and wherein each of said outer surfaces of said arms being is outwardly from said first edge to said second edge;

a plurality of rows of teeth being attached to each of said arms, each of said rows of teeth being attached to said inner surfaces of said distal portions of said arms;

wherein each of said rows of teeth extending, between opposite edges of said arms, wherein there are at least two rows of teeth attached to each arm and each of said arms has a row of teeth positioned adjacent to a respective second end of said arms.

2. The eating implement as in claim 1, wherein each of said middle portions has a width between edges less than the width of said proximal and distal portions.

3. The eating implement as in claim 1, wherein each of said outer surfaces of said middle portions has a plurality of channels therein extending between said first and second edges, said holding member being positionable in said channels.

4. The eating implement as in claim 1, wherein said holding member comprises a loop having a generally arcuate shape.

5. An eating implement comprising:

a tong-shaped member having a pair of arms each having a first end attached to a resiliently flexible connector, said arms extending outwardly in a generally parallel direction with respect to each other, said connector having a generally arcuate shape, said arms each having an outer surface and an inner surface, said inner surfaces facing each other, each of said arms having a first edge and a second edge defining opposite edges, each of said arms having a-middle portion, a distal portion and proximal portion with respect to said connector, each of said middle portions having a width between edges less than the width of said proximal and distal portions, each of said outer surfaces of said middle portions having a plurality of channels therein extending between opposite edges;

a plurality of rows of teeth being attached to each of said arms, each of said rows of teeth being attached to said inner surfaces of said distal portions of said arms, each of said rows of teeth extending between opposite edges of said arms, wherein there are at least two rows of teeth attached to each arm and each of said arms has a row of teeth positioned adjacent to a respective second end of said arms; and a holding member extending around said tong-shaped member and being positioned between said distal and proximal portions of said arms, said holding member comprising a loop having a generally arcuate shape, said holding member being extendable along said arms between said distal and proximal portions such that said holding member may be positioned in said channels, wherein said holding member holds said arms in a static relationship to each other.

6. The eating implement as in claim 5, wherein each of said outer surfaces of said arms is curved outwardly from said first edge to said second edge.

* * * * *